US005402856A

United States Patent [19]

Warren et al.

[11] Patent Number: 5,402,856

[45] Date of Patent: Apr. 4, 1995

[54] ANTI-WHIRL UNDERREAMER

[75] Inventors: Tommy M. Warren, Coweta; Lawrence A. Sinor, Tulsa, both of Okla.

[73] Assignee: Amoco Corporation, Chicago, Ill.

[21] Appl. No.: 171,240

[22] Filed: Dec. 21, 1993

[51] Int. Cl.[6] ..... E21B 7/28; E21B 10/32

[52] U.S. Cl. ..... 175/57; 175/263; 175/269; 175/399; 175/406; 175/408

[58] Field of Search ..... 175/57, 399, 398, 408, 175/263, 269, 325.2, 406

[56] References Cited

U.S. PATENT DOCUMENTS

| | | | |
|---|---|---|---|
| Re. 18,473 | 5/1932 | Hazlett . | |
| 668,340 | 2/1901 | Plotts . | |
| 1,121,573 | 12/1914 | Wetzel | 175/263 X |
| 1,128,878 | 2/1915 | Huntley . | |
| 1,332,841 | 3/1920 | Jansen . | |
| 3,231,033 | 1/1966 | Williams, Jr. | 175/334 |
| 3,237,705 | 3/1966 | Williams, Jr. | 175/406 |
| 3,306,378 | 2/1967 | Williams, Jr. | 175/325 |
| 3,331,439 | 7/1967 | Sanford | 166/55.8 |
| 3,751,177 | 8/1973 | Faber | 408/200 |
| 3,851,719 | 12/1974 | Thompson et al. | 175/406 |
| 3,861,477 | 1/1975 | Lazayres | 175/227 |
| 4,185,704 | 1/1980 | Nixon, Jr. | 175/325.2 X |
| 4,431,065 | 2/1984 | Andrews | 175/269 |
| 4,549,614 | 10/1985 | Kaalstad et al. | 175/408 X |
| 4,638,873 | 1/1987 | Welborn | 175/325.2 X |
| 4,706,765 | 11/1987 | Lee et al. | 175/334 |
| 4,815,342 | 3/1989 | Brett et al. | 76/108 |
| 4,862,974 | 9/1989 | Warren et al. | 175/61 |
| 4,982,802 | 1/1991 | Warren et al. | 175/57 |
| 5,042,596 | 8/1991 | Brett et al. | 175/57 |
| 5,052,503 | 10/1991 | Löf | 175/258 |
| 5,060,738 | 10/1991 | Pittard et al. | 175/267 |
| 5,109,935 | 5/1992 | Hawke | 175/399 X |

FOREIGN PATENT DOCUMENTS

| | | | |
|---|---|---|---|
| 1680924 | 9/1991 | U.S.S.R. | 175/263 |

*Primary Examiner*—Hoang C. Dang
*Attorney, Agent, or Firm*—Charles P. Wakefield; Richard A. Kretchmer

[57] ABSTRACT

An anti-whirl underreamer comprising a body configured for connection to a drillstring, at least two arms carried by the body which are extendable between a retracted position and a projected position, a movable piston and biased spring assembly for moving the arms, a plurality of cutting elements carried by one of the arms for cutting an axially extending cylindrical sidewall of the borehole within a subterranean formation and for applying a resultant radial force to the body as it rotates, and a low friction bearing region carried by another arm for transmitting the resultant radial force from the body to the sidewall of the borehole during rotation of the underreamer within the borehole. The cutting elements are positioned so that the resultant radial force developed is of sufficient magnitude and direction to substantially maintain the low friction bearing region in contact with the sidewall of the borehole as the underreamer is rotated within the borehole.

22 Claims, 2 Drawing Sheets

Fig. 1
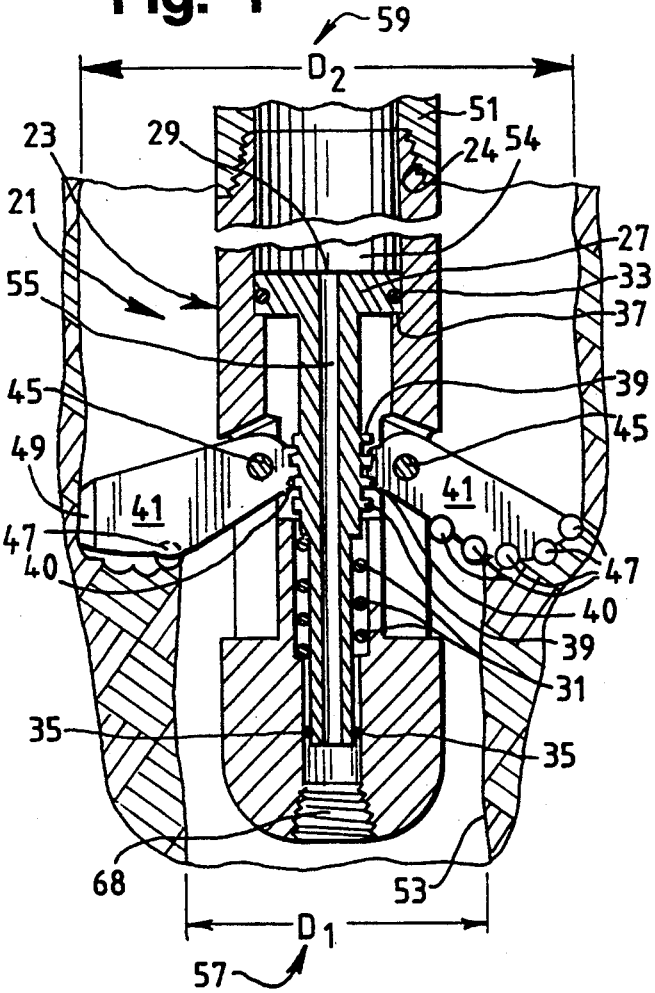
Fig. 3
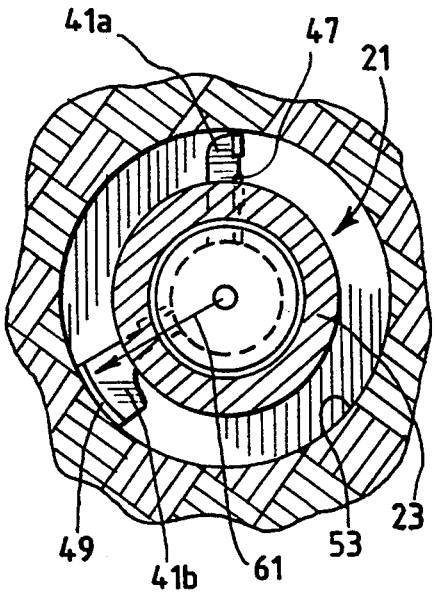
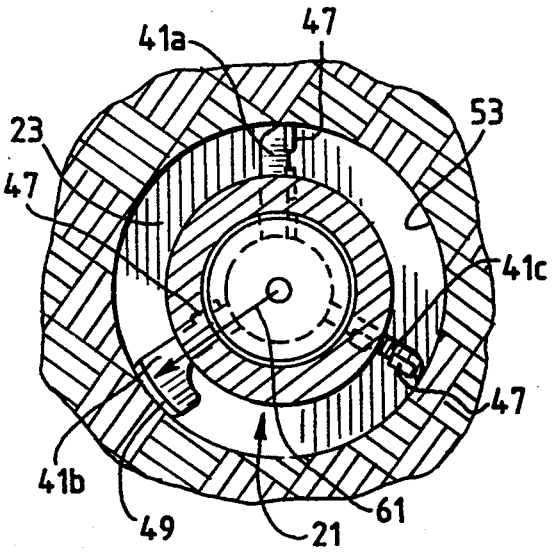
Fig. 2
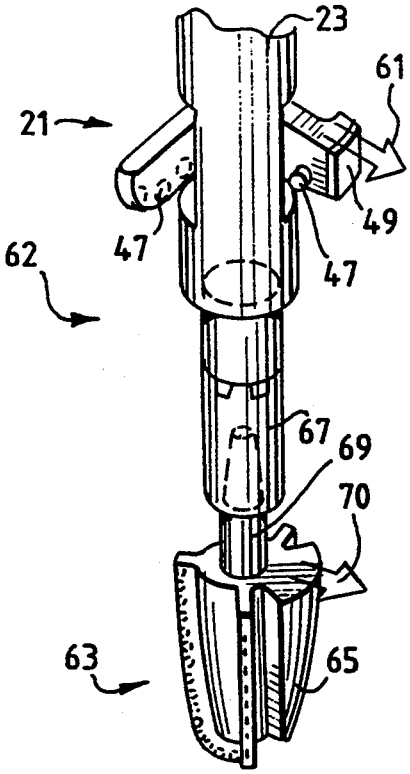
Fig. 4

ANTI-WHIRL UNDERREAMER

FIELD OF THE INVENTION

The present invention relates to drilling apparatus used to create boreholes within a subterranean formation and, more particularly, to methods and apparatus for enlarging a borehole.

BACKGROUND OF THE INVENTION

In the exploration and production of hydrocarbons, it is sometimes necessary to enlarge a borehole. The type of tool utilized to ream the borehole to a larger diameter is commonly called an "underreamer".

Underreaming a borehole is necessary, for example, when drilling through fast moving formations such as salt or sloughing shale. Fast moving formations can creep into the borehole, thereby decreasing the diameter of the borehole. The reduction of the size of the borehole can cause a hang-up of the drillstring. If a hang-up occurred, the drillstring could twist off and separate. This would delay drilling and require the use of complex tools to recover the separated section of drillstring. Also, the reduction of the diameter of the borehole can prevent the removal of a bottom-hole assembly from the borehole. The underreaming of the borehole will allow wells penetrating fast moving formations to be drilled more easily and effectively.

Underreaming is also desirable when drilling through formations which require multiple casing to be set within the borehole (such as very deep wells). Each time a casing is set, the diameter of borehole is reduced. To minimize this reduction in the borehole diameter, it is desirable to use casings whose outside diameter is very close to the inside diameter of the previous casing set. This, however, reduces the space available for cement. The subsequent reduction in the amount of cement between the casing and the borehole wall is undesirable.

In order to provide adequate space between the new casing and the borehole for adequate cement, the borehole below the level of the old casing should be enlarged.

Underreaming can also be used advantageously to enlarge the diameter of the borehole in the region from which hydrocarbons are recovered. The enlarged borehole will provide enhanced recovery of hydrocarbons and will also allow for the installation of a gravel pack or other apparatus which can enhance the recovery of hydrocarbons from the producing reservoir.

To underream a section of a formation, an underreaming tool must be run into the previously drilled section of the borehole to the designated depth. The underreaming tool must then be operated to underream the selected portion of the underground formation. Once the desired portion of the underground formation is underreamed, the underreaming tool must be removed from the borehole. This requires the tool be capable of being passed through a section of borehole which is smaller in diameter than the enlarged borehole which the tool must create.

In an attempt to provide a tool which satisfies the above requirements, several designs have been developed. In one type of design, the region carrying the cutting elements has a geometric center which is offset from the center of rotation of the tool. Once this type of tool is lowered to the area of the formation to be underreamed, it is rotated in the hole. Due to the offset design of the tool, a borehole is produced which has a larger diameter than the borehole through which the tool was lowered. This type of design is exemplified by the tool disclosed in U.S. Pat. No. 3,851,719, to Thompson et al. One limitation of tools of this design is that they are unstable and inefficient. Also, tools of this design are subject to a phenomenon known as "whirl".

Whirl occurs on an underreamer when it does not rotate smoothly about its central axis of rotation. This is a result of the radial imbalance forces created during the cutting process. These imbalance forces cause the instantaneous center of rotation of the underreamer to become some point other than the centerline of the borehole. As the underreamer rotates, the instantaneous center of rotation changes relative to the centerline of the borehole. This causes the underreamer to move laterally or whirl around the borehole. When the tool whirls, the center of rotation can change randomly relative to the centerline of the borehole. Alternatively, the movement of the center of rotation of the tool relative to the centerline of the borehole may follow a regular pattern, such as the pattern Created by a tool exhibiting "backward whirl". Backward whirl occurs when the frictional contact between the cutting elements and the wellbore cause the underreamer to roll counter-clockwise around the surface of the wellbore as the underreamer rotates in a clockwise direction. The whirling process is regenerated because of the friction which is always generated between the cutting elements of the underreamer and the borehole wall and because of centrifugal forces which continually act on the underreamer.

A cutting element on an underreamer exhibiting whirl is subject to increased impact loads which at times are directed in a reverse or sideways direction from that which would be expected for the designed direction of travel. These increased impact loads cause increased wear and breakage of the cutting elements.

Other tools, such as the one disclosed in U.S. Pat. No. 5,060,738 to Pitlard et al., utilize Cutting elements which are carried on extendable arms. With the arms in a retracted position, the underreamer may be run into the existing borehole and then extended to a projected position. As the drillstring to which the tool is attached is rotated, the cutting elements cut into the sidewall of the formation to expand the radius of the borehole. With the arms in a raised position, the desired section of the borehole is underreamed to a larger diameter. The arms are then retracted and the underreamer is removed from the borehole.

Studies have shown that underreamers, such as disclosed in the Pittard et al. patent, are also unstable and subject to whirl, due to circumferential drilling imbalance forces which act on this type of underreamer. Various methods have been utilized in an attempt to improve the performance of underreamers which have expandable arms. The methods include reducing the reaming speed and dynamically balancing the underreamer and lower drillstring. Developers have typically focused on building more robust underreaming tools. It was hoped that by building more robust tools, cutter and arm breakage could be prevented or at least minimized. This philosophy has resulted in designs which utilized one-piece arms versus two-piece arms, designs with increased cutter density to limit individual cutter loading, designs in which the cutter profile has been modified in an attempt to limit cutter loading, and designs in which the cutters have been placed in a position that will limit individual cutter loading.

SUMMARY OF THE INVENTION

A general object of the invention is to provide an apparatus and method for underreaming a borehole within a subterranean formation.

A more specific object of this invention is to provide a rotary drilling apparatus for enlarging a borehole within a subterranean formation from a first diameter to a second diameter.

In accordance with one embodiment of the present invention, a rotary underreamer for enlarging a borehole in an underground formation is disclosed. The underreamer comprises: a body for connection to a drillstring; at least two arms carried by the body and radially extendable between a retracted position and a projected position; means carried by the body for moving the arms; a plurality of cutting elements carried on one of the arms for cutting an axially extending cylindrical sidewall of the borehole and for applying a resultant radial force to the body as it rotates; and a low friction bearing means located on another of the arms for transmitting the resultant radial force from the body to the sidewall of the borehole, the cutting elements being positioned to ensure the resultant radial force is of sufficient magnitude and direction to substantially maintain the low friction bearing means in contact with the borehole as the underreamer is rotated within the borehole. By maintaining the low friction bearing means in contact with the sidewall of the borehole, destructive whirl is minimized.

In accordance with another embodiment of the present invention, a drilling apparatus for forming a borehole in an underground formation is disclosed. The drilling apparatus comprises: a body having an upper end configured for connection to a drillstring, the body having an instantaneous center of rotation as the drilling apparatus is rotated within the borehole; a plurality of arms radially extendable between a retracted position and a projected position; means carried by the body for moving the arms; a plurality of cutting elements carried on one of the arms for cutting an axially extending cylindrical sidewall of the borehole and for applying a resultant radial force to the body as it rotates; and a low friction bearing means located on another of the arms for transmitting the resultant radial force from the body to the sidewall of the borehole, the cutting elements being positioned to provide a resultant radial force of sufficient magnitude and direction to maintain the instantaneous center of rotation of the body substantially coincident with the centerline of the borehole as the drilling apparatus is rotated within the borehole.

In accordance with a third embodiment of the present invention, a method of underreaming a borehole in an underground formation from a first diameter to a second diameter is disclosed. The method comprises the steps of:

a) lowering a rotary underreamer attached to a rotational drive source into the borehole to the region of the borehole to be underreamed the rotary underreamer having: at least two arms that are radially movable between a retracted position and a projected position; a plurality of cutting elements carried on one of the arms for cutting an axially extending cylindrical sidewall of the borehole; and a low friction bearing means located on another one of the arms for transmitting a resultant radial force to the sidewall of the borehole;

b) rotating the underreamer while extending the plurality of arms to the projected position to axially extend the cylindrical sidewall of the borehole to the second diameter, the cutting elements being positioned to develop the resultant radial force as the underreamer is rotated within the borehole, the resultant radial force being of sufficient magnitude and direction to substantially maintain the low friction bearing means in contact with the borehole as the underreamer is rotated within the borehole; and c) applying a forward force to the underreamer while rotating the underreamer to extend the length of the borehole having the second diameter.

The manufacturers and developers of prior underreamers did not recognize that the failure of the cutting elements and the arms which carry the cutting elements were the result of increased impact loads caused by whirling of the tools about the hole. It was only discovered that underreamers are subject to whirl through extensive experimentation and analysis by the inventors. The current invention's use of a low friction bearing means is directly opposite to prior art techniques. Since the low friction bearing means takes up space, its use will reduce the number of cutting elements present ion the underreamer. This reduction in the number of cutting elements will increase the load on each individual cutting element. Accordingly, one who was trying to reduce the load on each individual cutting element would not use a low friction bearing means as utilized in the current invention.

The current invention's development of a resultant radial force which is directed to a low friction bearing means minimizes whirling of the underreamer about the borehole. This will provide a tool which is able to efficiently ream a borehole at a high rate without exhibiting destructive whirl. The underreamer of the current invention thereby produces a tool with increased service life which also provides an acceptable penetration rate in most applications.

Numerous other advantages and features of the present invention will become readily apparent from the following detailed description of the invention, the embodiments described therein, from the claims, and from the accompanying drawings.

BRIEF DESCRIPTION OF THE DRAWINGS

FIG. 1 is a partial cross-sectional side view of one embodiment of the invention.

FIG. 2 is a partial cross-sectional plan view of a three-bladed underreamer of this invention.

FIG. 3 is a partial cross-sectional plan view of a two-bladed underreamer of this invention.

FIG. 4 is a perspective side view of a drilling apparatus of the present invention having an underreamer coupled to an anti-whirl drill bit.

DESCRIPTION OF THE PREFERRED EMBODIMENTS

Figure 5:
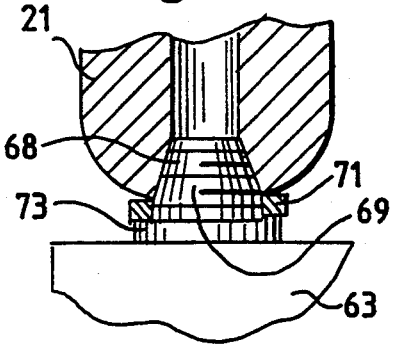
FIG. 5 is a side view of one embodiment of an alignment means used to couple the underreamer of the present invention to an anti-whirl drill bit.

While this invention is susceptible of embodiment in many different forms, there is shown in the drawings, and will herein be described in detail, specific embodiments of the invention. It should be understood, however, that the present disclosure is to be considered an exemplification of the principles of the invention and is not intended to limit the invention to the specific embodiments illustrated.

Briefly, the present invention is a rotary underreamer for use in a subterranean formation. The underreamer has a plurality of extendable arms which carry cutting elements. The arms may be straight or curved. At least one of the arms carries a low friction bearing means. The arms extend radially outward. This will allow the underreamer to be passed down a small diameter hole to a position in the formation which is intended to be underreamed.

Turning to the drawings, FIG. 1 illustrates one embodiment of the underreamer 21 that is the subject of the present invention. In particular, the underreamer 21 comprises a housing 23, with threads 24 located at the housing's upper end for connecting the underreamer to a source of rotation. The source of rotation 25 can be a downhole motor or rotating drillstring 51. Located within the housing 23 is a slidable piston assembly 27. The piston assembly 27 contains a flow passage 29 which channels the drilling fluid from the source of rotation, preferably a drillstring, through the underreamer 21 before being discharged into the formation. The piston assembly 27 is moveably carried in the housing by a biasing spring 31. Seals 33 and 35 prevent the fluid from bypassing the piston assembly 27. The seals are preferably made of materials which lower the force required to move the piston assembly 27 within the housing 23. The piston assembly's movement within the housing is limited by a stop 37. The piston assembly 27 has teeth 39 which mesh with teeth 40 located on extendable arms 41, which are shown in a projected position. The spring 31 exerts a force on the piston assembly 27, which acts through the teeth 39 and 40, to bias the extendable arms 41, which are pivotly mounted on the body by pins 45, toward a retracted position. The arms 41 can be connected to the underreamer 21 in several ways. For example, the arms 41 can be pivotally attached to extend upwardly toward the drillstring 51; they can be pivotally attached to extend downwardly away from the drillstring 51; or they can be articulated along the longitudinal axis of the underreamer 21, so that they fold out from the body of the underreamer.

The arms 44 can be moved by a variety of means including hydraulically actuated devices or any other suitable means. The identity of the available means for moving the arms 41 is known to one of ordinary skill in the art. Preferably, the arms 41 should be biased so that they will return to a retracted position when no force is applied to keep them in a projected position. This will facilitate removal of the underreamer from the borehole once the desired section of borehole has been underreamed.

Primary cutting elements 47 are located on at least one of the arms 41. A low friction bearing means 49 is carried on another one of the arms. An arm which carries the low friction bearing means 49 can also carry primary cutting elements 47.

Each of the extendable arms can be molded with the cutting elements in place, or the cutting elements may be brazed or pressed into position on the arms. The cutting elements comprise polycrystalline diamond compacts or any other material suitable for removing subterranean material from a borehole.

The placement of the cutting elements with respect to the low friction bearing means can be optimized using the method disclosed in U.S. Pat. No. 5,042,596, to Brett et al., which is incorporated herein by reference. The Brett et al. patent teaches in general how to determine the proper placement of cutting elements on a drilling apparatus. In addition, the teachings in Brett et al. regarding the location and size of a bearing zone can be utilized to design the low friction bearing means of the current invention.

The low friction bearing means can be constructed in a variety of ways. Preferably, the surface area of the low friction bearing means should be sized so that the force per area applied to the walls of the borehole, as a result of the resultant radial force, will not exceed the compressive strength of the subterranean earthen material being underreamed.

The low friction bearing means should have a lower relative coefficient of friction during operation than the region where the primary cutting elements are located. In one aspect of the invention, the low friction bearing means has a reduced number of cutting elements relative to the region where the primary cutting elements are located. In a second aspect of the invention, the low friction bearing means comprises secondary cutting elements which are recessed relative to the primary cutting elements not located on the low friction bearing means. In this second aspect of the invention, the secondary cutting elements cut less than the primary cutting elements and therefore the low friction bearing means does not provide as much resistance to the rotation of the underreamer as the area of the underreamer where the primary cutting elements are located. These secondary cutting elements will not cut as much as the primary cutting elements until the primary cutting elements have been worn to the same height as the secondary cutting elements. In further aspects of the invention, the low friction bearing means comprise sliding pads or rollers, the faces of which may incorporate hardened pins or hardened pads.

Referring to FIG. 2, illustrated is a partial cross-sectional plan view of an embodiment of the invention with three arms 41*a*, 41*b*, and 41*c* which are shown in an extended position. As the underreamer 21 is rotated and the borehole 53 is enlarged, the primary cutting elements 47 interaction with the borehole wall 53 creates a resultant radial force 61 on housing 23 which is directed toward the low friction bearing means 49. This resultant radial force 61 is transferred from the housing 23 to the extendable arm 41*b* which carries the low friction bearing means 49. The resultant radial force 61 causes the low friction bearing means 49 to engage the borehole wall 53. The low friction bearing means 49 and the magnitude and direction of the resultant radial force 61 are preferably designed to ensure that the low friction bearing means 49 maintains contact with the borehole wall 53 as the borehole is enlarged in diameter, thereby preventing the occurrence of destructive whirl within the borehole. Additionally, the resultant radial force 61 and the low friction bearing meant; 49 should be sized so that the force applied to the sidewall of the borehole 53 will not exceed the compression strength of the subterranean earthen material being underreamed.

FIG. 3 is a partial cross-sectional plan view of an embodiment of the invention with two arms 41*a* and 41*b* shown in an extended position. One arm 41*a* carries a plurality of primary cutting elements 47. The second arm 41*b* carries a low friction bearing means 49. The second arm 41*b* is preferably located about 120 degrees behind the first arm 41*a*, as measured about the axis of rotation and with respect to the normal direction of rotation of the underreamer during underreaming operation. The separation of the first arm 41*a* and the second arm 41*b* by 120 degrees, with the second arm trailing the first arm during underreaming operations, places the low friction bearing means 49 in the preferable position to receive the resultant radial force 61.

FIG. 4 represents another embodiment of the invention. In this embodiment of the invention, a drilling assembly 62 comprising an anti-whirl drill bit 63, such as described in U.S. Pat. No. 5,042,596, is coupled to underreamer 21 at the underreamer's lower end. The anti-whirl drill bit 63 is utilized to create a pilot borehole of a first diameter which the underreamer 21 then enlarges to a second larger :diameter. Preferably, the underreamer 21 and anti-whirl drill bit 63 are coupled so that a bearing zone 65 of the anti-whirl drill bit and the low friction bearing means 49 of the underreamer are aligned through the use of alignment means 67. The alignment of the low friction bearing means 49 and the bearing zone 65 will enable the resultant radial force 61 developed on the underreamer 21 and the resultant radial force 70 developed on the anti-whirl drill bit 63 to cooperatively maintain the drilling assembly 62 aligned in the borehole. Also, the alignment of the resultant radial forces may allow a simpler drilling apparatus assembly to be utilized which does not required stabilizers or other devices capable of stabilizing a bottom-hole assembly. If the resultant radial forces are not aligned, the drilling assembly may not drill a straight borehole. The drilling assembly may also precess about its longitudinal axis if the resultant radial forces are not aligned. The alignment of the anti-whirl bit and the underreamer is particularly important when the distance between the drill bit and the underreamer is less than approximately 5 feet and no stabilizer is mounted between the drill bit and the underreamer.

The alignment of the underreamer and the drill bit can be facilitated, for example, by using threaded connectors with or without the use of a pad alignment is between the anti-whirl drill bit and the underreamer.

FIG. 5 is an example of one type of alignment means which can be utilized with the present invention. In this embodiment of the invention, the lower end of an underreamer 21 contains threads 68 to receive a threaded shank 69 of an anti-whirl drill bit 63. Shims 71 are utilized to ensure proper alignment of the anti-whirl drill bit 63 and the underreamer 21. The shims 71 are placed circumferentialty around shank 69, between a shank collar 73 and the lower end of underreamer 21. The shims 71 are sized to ensure that the bearing zone of the anti-whirl drill bit and the low friction bearing means of the underreamer align when the threaded connection is torqued to its proper value.

Figure 6:
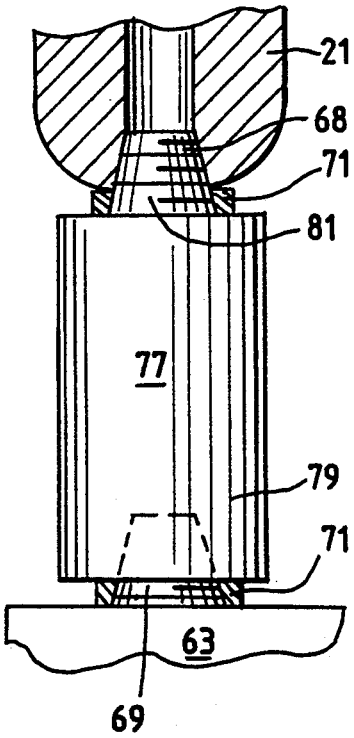
FIG. 6 is a side view of another embodiment of an alignment means used to couple the underreamer of the present invention to an anti-whirl drill bit.

FIG. 6 illustrate, s another type of alignment means utilized with the present invention. In this embodiment, a short subassembly 77 is used to couple the underreamer 21 to the anti-whirl drill bit 63. The subassembly has a first end 79 and a second end 81, both of which are threaded. The first end 79 mates with the threaded shank 69 of the anti-whirl drill bit 63 and the second end 81 mates with the threaded lower end 68 of the underreamer 21. Shims 71 may be utilized to ensure that the low friction bearing means of the underreamer and the bearing zone of the anti-whirl drill bit are properly aligned.

Figure 7:
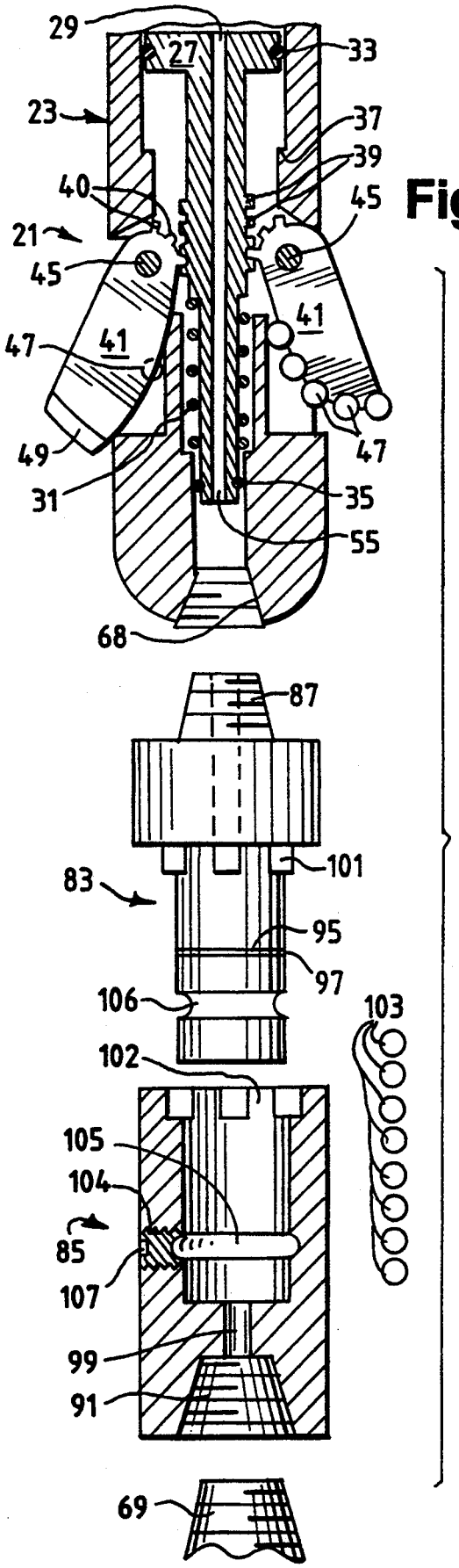
FIG. 7 is a partial cross-sectional side elevated view of the underreamer of the present invention coupled to an anti-whirl drill bit by use of another embodiment of an alignment means.

FIG. 7 illustrates a third type of alignment means used to couple an underreamer 21 to an anti-whirl drill bit. The underreamer 21 is shown with the extendable arms 41 retracted. The alignment means comprises an upper orienting sub 83 and a lower orienting sub 85. The upper orienting sub 83 has a threaded upper end 87 for connecting to a threaded lower end 68 of the underreamer 21. The lower orienting sub 85 has a threaded lower end 91 for connecting to a threaded shank 69 of the anti-whirl drill bit. The threaded ends are connected and torqued to a desired value. A seal 95 is placed in the seal groove 97; this seal will ensure that drilling fluid is directed through passage 99 to the anti-whirl drill bit to provide proper lubrication and cooling of the anti-whirl drill bit. Once the seal 95 is installed, the upper orienting sub 83 and the lower orienting sub 85 are brought together. The low friction bearing means 49 of the underreamer 21 and the bearing zone 65 of the anti-whirl drill bit are visually aligned so that the torque transmission teeth 101 and 102, located respectively on the upper and lower orienting subs, mesh. Retaining balls 103 are then inserted through a ball retaining orifice 104 into the ball retainer race formed by the mating of a groove 105 on the lower orienting sub 85 and a groove 106 on the upper orienting sub 83. The balls 103, once inserted into the race, will hold the lower and upper orienting subs together while the subterranean formation is being underreamed. A ball retaining plug 107 is inserted into the ball retaining orifice 104 to ensure the balls 103 are retained in the race. The torque transmission teeth 101 and 102 maintain the proper alignment of the underreamer and the anti-whirl drill bit.

Referring to FIG's 1 through 7, the underreamer of the present invention is operated in the following manner. The underreamer 21 coupled to the drillstring 51 is lowered to the desired position within the borehole 53. Once in position, the underreamer 21 is rotated by the drillstring 51. As the underreamer 21 rotates, drilling fluid 54 is pumped under pressure into the drillstring 51. The flow passage 29 directs the drilling fluid 54 into channel 55. As the fluid flows through the channel 55, a downward force is exerted on the top of the piston assembly 27. This downward force counteracts the upward force applied to the piston assembly by the biasing spring 31, thereby causing the piston assembly 27 to move within the housing 23. As the piston assembly 27 moves, the seals 33 and 35 prevent the drilling fluid from bypassing channel 55 within the piston assembly. The downward movement of the piston assembly 27 causes gear teeth 39 on the piston assembly to engage the teeth 40 on the extendable arms. This causes the arms to pivot about pins 45, thereby extending the arms toward the sidewall of the borehole. As the underreamer continues to rotate, the primary cutting elements 427 cut into the formation and extend the diameter of the borehole from a first diameter 57 to a second diameter 59. The arms continue to extend until the piston assembly 27 engages the stop 37. Once the arms are fully extended, a downward force is applied to the underreamer while continuously rotating the drillstring and pumping drilling fluid into the drillstring. The downward force applied to the underreamer causes the underreamer to move forward, thereby enlarging the desired section of borehole.

From the foregoing description, it can be observed that numerous variations, alternatives arid modifications will be apparent to those skilled in the art. Accordingly, this description is to be construed as illustrative only and is for the purpose of teaching those skilled in the art the manner of carrying out the invention. Various changes may be made, materials substituted and features of the invention may be utilized. For example, a system using interlocking sleeves with pins may be used to couple the various parts of a drilling apparatus to one another. Alternatively, flanges or splines may be used together with bolts, clamps, or pins to couple the various parts of the drilling apparatus to one another.

Thus, it will be appreciated that various modifications, alternatives, variations, etc., may be made without departing from the spirit and scope of the invention as defined in the appended claims. It is, of course, intended that the appended claims cover all such modifications involved within the scope of the claims.

What is claimed is:

1. A rotary underreamer for enlarging a sidewall of a borehole within an underground formation from a first diameter to a second diameter, comprising:

a body for connection to a drillstring;

three arms carried by said body and radially extendable between a retracted position, for passing the underreamer through the sidewall having the first diameter, and a projected position, wherein the distal ends of the arms extend beyond the sidewall having the first diameter to enlarge the borehole to the second diameter;

means carried by said body for moving said arms;

a plurality of cutting elements carried on a first and a second of said arms for cutting an axially extending cylindrical sidewall having the second diameter and for applying a resultant radial force to said body as it rotates; and a low friction bearing means carried on a third of said arms for transmitting said resultant radial force from said body to the sidewall of the borehole, said cutting elements being positioned to ensure said resultant radial force is of sufficient magnitude and direction to substantially maintain said low friction bearing means in contact with the borehole as the underreamer is rotated within the borehole.

2. The rotary underreamer of claim 1, wherein said means carried by said body for moving said arms comprises:

means for extending said arms between the retracted position and the projected position; and means for retracting said arms.

3. The rotary underreamer of claim 2, wherein the means for retracting said arms comprises:

a spring; and a slidable piston assembly carried on said spring and having a first set of teeth which mesh with a second set of teeth located on said extendable arms, said spring biasing said slidable piston to cause said arms to be biased to said retracted position.

4. The rotary underreamer of claim 1, wherein said body has an upper end and a lower end, said upper end being configured for connection to a source of rotation and said lower end being configured to receive a drill bit.

5. The rotary underreamer of claim 4, further including an anti-whirl drill bit coupled to the underreamer at said lower end, said anti-whirl drill bit having a bearing zone for receiving a second resultant radial force developed by said anti-whirl drill bit as said anti-whirl drill bit rotates within the borehole.

6. The rotary underreamer of claim 5, further comprising coupling and aligning means for coupling said anti-whirl drill bit to said lower end of said body and for aligning said bearing zone of said anti-whirl drill bit to said low friction being means.

7. The rotary underreamer of claim 6, wherein said coupling and aligning means comprises:

an upper orienting sub having a first end configured for connection to said lower end of said body;

a lower orienting sub having a first end configured for connection to said anti-whirl drill bit; and means for connecting said lower orienting sub to said upper orienting sub.

8. The rotary underreamer of claim 7, wherein said means for connecting said upper orienting sub to said lower orienting sub comprises:

torque transmission teeth located on a second end of said upper orienting sub;

torque transmission teeth located on a second end of said lower orienting sub; and means for meshing said torque transmission teeth located on said second end of said lower orienting sub with said torque transmission teeth located on said second end of said upper orienting sub.

9. The rotary underreamer of claim 8, wherein said means for meshing comprises:

a first groove located on said upper orienting sub;

a second groove located on said lower orienting sub, said first groove and said second groove capable of being aligned to form a race; and retaining balls capable of being placed within said race formed by said first groove and said second groove.

10. A rotary underreamer for enlarging a sidewall of a borehole within an underground formation from a first diameter to a second diameter, comprising:

a body for connection to a drillstring;

at least two arms carried by said body and radially extendable between a retracted position for passing the underreamer through the sidewall having the first diameter and a projected position, wherein the distal ends of the arms extend beyond the sidewall having the first diameter to enlarge the borehole to the second diameter;

means carried by said body for extending said arms between the retracted position and the projected position;

means for retracting said arms, comprising:

a spring; and a slidable piston assembly carried on said spring and having a first set of teeth which mesh with a second set of teeth located on said extendable arms, said spring biasing said slidable piston to cause said arms to be biased to said retracted position;

a plurality of cutting elements carried on one of said arms for cutting an axially extending cylindrical sidewall of the borehole having the second diameter and for applying a resultant radial force to said body as it rotates; and a low friction bearing means carried on another of said arms for transmitting said resultant radial force from said body to the sidewall of the borehole, said cutting elements being positioned to ensure said resultant radial force is of sufficient magnitude and direction to substantially maintain said low friction bearing means in contact with the borehole as the underreamer is rotated within the borehole:

11. The rotary underreamer of claim 10, wherein said underreamer has at least three arms.

12. A drilling apparatus for forming a second section of borehole in an underground formation, the second section of borehole having a diameter larger than a first section of borehole and axially extending beyond the first section of borehole, the apparatus comprising:

a rotary underreamer comprising:

a body having an upper end configured for connection to a drillstring and a lower end configured to receive a drill bit, said body having an instantaneous center of: rotation as the drilling apparatus is rotated within the borehole;

a plurality of arms radially extendable between a retracted position, which allows the underreamer to be passed through the first section of borehole and a projected position, wherein the distal ends of the arms extend radially beyond the sidewall of the first section of borehole;

means carried by said body for moving said arms;

a plurality of cutting elements carried on one of said arms for cutting an axially extending cylindrical sidewall of the borehole and for applying a resultant radial force to said body as it rotates; and a low friction bearing means located on another of said arms for transmitting said resultant radial force from said body to the sidewall of the borehole, said cutting elements being positioned to provide said resultant radial force of sufficient magnitude and direction to maintain said instantaneous center of rotation of said body substantially coincident with the centerline of the borehole as the drilling apparatus is rotated within the borehole; and an anti-whirl drill bit coupled to said underreamer at said lower end of said body of said underreamer said anti-whirl drill bit having a bearing zone for receiving a second resultant radial force developed by said anti-whirl drill bit as said anti-whirl drill bit rotates within the borehole.

13. The drilling apparatus of claim 12, further comprising coupling and aligning means for coupling said anti-whirl drill bit to said lower end of said underreamer and for aligning said bearing zone of said anti-whirl drill bit to said low friction bearing means.

14. The drilling apparatus of claim 13, wherein said coupling and aligning means comprises a subassembly having a first end configured for connection with said anti-whirl drill bit and having a second end configured for connection with said lower end of said body of said rotary underreamer.

15. The drilling apparatus of claim 13, wherein said coupling and aligning means comprises:

an upper orienting sub having a first end configured for connection to said lower end of said body of said rotary underreamer;

a lower orienting sub having a first and configured for connection to said anti-whirl drill bit; and means for connecting said lower orienting sub to said upper orienting sub.

16. The drilling apparatus of claim 15, wherein said means for connecting said upper orienting sub to said lower orienting sub comprises:

torque transmission teeth located on a second end of said upper orienting sub;

torque transmission teeth located on a second end of said lower orienting sub; and means for meshing said torque transmission teeth located on said second end of said lower orienting sub with said torque transmission teeth located on said second end of said upper orienting sub.

17. The drilling apparatus of claim 16, wherein said means for meshing comprises:

a first groove located on said upper orienting sub;

a second groove located on said lower orienting sub, said first groove and said second groove capable of being aligned to form a race;

and retaining balls capable of being placed within said race formed by said first groove and said second groove.

18. A method of underreaming a borehole in an underground formation from a first diameter to a second diameter which is larger than the first diameter, the method comprising the steps of:

a) lowering a rotary underreamer attached to a rotational drive source into the borehole to the region of the borehole to be underreamed, the rotary underreamer having:

at least two arms that are radially movable between a retracted position, for passing the underreamer through a section of the borehole having the first diameter, and a projected position, wherein the distal end of the arms extend radially beyond the sidewall of a borehole having the first diameter;

a plurality of cutting elements carried on one of said arms for cutting an axially extending cylindrical sidewall of the borehole; and a low friction bearing means located on another one of said arms for transmitting a resultant radial force to the sidewall of the borehole;

b) rotating said underreamer while extending said arms to said projected position to enlarge the cylindrical sidewall of the borehole to the second diameter, said cutting elements being positioned to develop said resultant radial force as said underreamer is rotated within the borehole, said resultant radial force being of sufficient magnitude and direction to substantially maintain said low friction bearing means in contact with the borehole as said underreamer is rotated within the borehole.; and c) applying a forward force to said underreamer while rotating said underreamer to extend the length of the borehole having the second diameter.

19. The method of claim 18, further including the steps of:

d) moving said arms to said retracted position; and e) withdrawing said underreamer from the borehole.

20. The method of claim 18, wherein prior to performing step a) said rotary underreamer is coupled to an anti-whirl drill bit having a bearing zone for receiving a second resultant radial force created by said anti-whirl drill bit as said anti-whirl drill bit drills a borehole in the underground formation, said rotary underreamer and said anti-whirl drill bit being coupled by coupling and alignment means which align said bearing zone of said anti-whirl drill bit to said low friction bearing means; and whereby said anti-whirl drill bit drills a pilot borehole which is later enlarged by said rotary underreamer.

21. The method of claim 20, wherein said underreamer and said anti-whirl drill bit are positioned less than about five feet apart.

22. A rotary underreamer for enlarging a sidewall of a borehole within an underground formation from a first diameter to a second diameter, comprising:

a body for connection to a drillstring;

a maximum of two arms carried by said body and radially extendable between a retracted position for passing the underreamer through the sidewall having the first diameter and a projected position, wherein the distal ends of the arms extend beyond the sidewall having the first diameter to enlarge the borehole to the second diameter;

means carried by said body for moving said arms;

a plurality of cutting elements carried on a first arm for cutting an axially extending cylindrical sidewall having the second diameter and for applying a resultant radial force to said body as it rotates; and a low friction bearing means carried on a second arm located approximately 120 degrees behind said first arm as measured about the axis of rotation of the; underreamer, said low friction bearing means capable of transmitting said resultant radial force from said body to the sidewall of the borehole, said cutting elements being positioned to ensure said resultant radial force is of sufficient magnitude and direction to substantially maintain said low friction bearing means in contact with the borehole as the underreamer is rotated within the borehole.

* * * * *

UNITED STATES PATENT AND TRADEMARK OFFICE
CERTIFICATE OF CORRECTION

PATENT NO.: 5,402,856

DATED: April 4, 1995

INVENTOR(S): Tommy M. Warren, Lawrence A. Sinor

It is certified that error appears in the above-identified patent and that said Letters Patent is hereby corrected as shown below:

| Col. | Line | |
|---|---|---|
| 4 | 27-28 | "cutting elements present ion the underreamer." should read --cutting elements present on the underreamer.-- |
| 6 | 67 | "the low friction bearing meant; 49" should read --the low friction bearing means 49-- |
| 7 | 49-50 | "the use of a pad alignment is between the anti-whirl drill bit and the underreamer." should read --the use of a pad alignment sub between the anti-whirl drill bit and the underreamer.-- |
| 7 | 64 | "FIG. 6 illustrate, s another type of alignment means" should read --FIG. 6 illustrates another type of alignment means-- |

UNITED STATES PATENT AND TRADEMARK OFFICE
CERTIFICATE OF CORRECTION

PATENT NO.: 5,402,856

DATED: April 4, 1995

INVENTOR(S): Tommy M. Warren, Lawrence A. Sinor

It is certified that error appears in the above-identified patent and that said Letters Patent is hereby corrected as shown below:

| Col. | Line | |
|---|---|---|
| 8 | 62-63 | "the primary cutting elements 427" should read --the primary cutting elements 47-- |
| 9 | 5 | "numerous variations, alternatives arid modifications" should read --numerous variations, alternatives and modifications-- |
| 11 | 65 | "a lower orienting sub having a first and configured" should read --a lower orienting sub having a first end configured-- |

Signed and Sealed this

Third Day of October, 1995

*Attest:*

Bruce Lehman

BRUCE LEHMAN

*Attesting Officer*

*Commissioner of Patents and Trademarks*